US010826244B2

(12) United States Patent
Zhao et al.

(10) Patent No.: US 10,826,244 B2
(45) Date of Patent: Nov. 3, 2020

(54) ELECTRICAL CONNECTOR HAVING A CERAMIC BODY PART AND A METALLIC SHIELDING PLATE MOLDED TO THE CERAMIC BODY PART

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Jun Zhao, Huaian (CN); Cai-Yun Zhang, Huaian (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/249,915

(22) Filed: Jan. 17, 2019

(65) Prior Publication Data

US 2019/0229471 A1 Jul. 25, 2019

(30) Foreign Application Priority Data

Jan. 23, 2018 (CN) ..... 2018 1 0061716

(51) Int. Cl.
*H01R 13/6585* (2011.01)
*H01R 13/405* (2006.01)
(Continued)

(52) U.S. Cl.
CPC ..... *H01R 13/6585* (2013.01); *H01R 13/405* (2013.01); *H01R 13/504* (2013.01);
(Continued)

(58) Field of Classification Search
CPC ..... H01R 2107/00; H01R 24/60; H01R 13/6585; H01R 13/6594; H01R 13/405;
(Continued)

(56) References Cited

U.S. PATENT DOCUMENTS 8,461,465 B2 * 6/2013 Golko ..... H01R 13/516 174/359
9,306,336 B2 * 4/2016 Chang ..... H01R 13/6471
(Continued)

FOREIGN PATENT DOCUMENTS

CN 106129688 A * 11/2016 ..... H01R 13/46
CN 205944552 U 2/2017
CN 107658618 A 2/2018

OTHER PUBLICATIONS

English Translation of CN 106129688 (Year: 2016).*

*Primary Examiner* — Edwin A. Leon
*Assistant Examiner* — Matthew T Dzierzynski
(74) *Attorney, Agent, or Firm* — Wei Te Chung; Ming Chieh Chang

(57) ABSTRACT

An electrical connector includes: a body including a ceramic part and an over-mold; an upper row of contacts and a lower row of contacts secured to the ceramic part of the body, each row of contacts including an outermost ground contact and a pair of signal contacts inwardly of the ground contact; and a metallic shielding plate situated between the upper pair of signal contacts and the lower pair of signal contacts, wherein the metallic shielding plate is molded to the ceramic part of the body.

16 Claims, 14 Drawing Sheets

(51) Int. Cl.

| | |
|---|---|
| ***H01R 13/504*** | (2006.01) |
| ***H01R 43/18*** | (2006.01) |
| ***H01R 43/24*** | (2006.01) |
| ***H01R 13/6599*** | (2011.01) |
| ***H01R 107/00*** | (2006.01) |
| ***H01R 24/60*** | (2011.01) |

(52) U.S. Cl.
CPC ..... *H01R 43/18* (2013.01); *H01R 13/6599* (2013.01); *H01R 24/60* (2013.01); *H01R 43/24* (2013.01); *H01R 2107/00* (2013.01)

(58) Field of Classification Search
CPC ..... H01R 13/504; H01R 13/6581; H01R 13/6591; H01R 12/724; H01R 13/502; H01R 13/5202; H01R 13/6582; H01R 13/6583; H01R 12/707; H01R 12/71; H01R 13/40; H01R 13/521; H01R 13/533; H01R 13/631; H01R 13/6466; H01R 13/6477; H01R 13/652; H01R 13/658; H01R 13/6587; H01R 13/6593; H01R 13/6596; H01R 13/6599; H01R 24/00; H01R 24/62; H01R 24/64; H01R 43/0221; H01R 43/18; H01R 43/24
See application file for complete search history.

(56) References Cited

U.S. PATENT DOCUMENTS

| | | | | |
|---|---|---|---|---|
| 9,515,405 | B2 * | 12/2016 | Zhao | H01R 13/405 |
| 9,553,410 | B2 * | 1/2017 | Zhao | H01R 13/6581 |
| 9,590,347 | B2 * | 3/2017 | Zhao | H01R 13/504 |
| 9,893,473 | B2 * | 2/2018 | Kong | H01R 13/6594 |
| 9,991,640 | B2 * | 6/2018 | Tziviskos | H01R 13/6581 |
| 10,063,015 | B2 * | 8/2018 | Zhao | H01R 13/5202 |
| 10,170,867 | B2 * | 1/2019 | Ju | H01R 13/6585 |
| 10,218,134 | B2 * | 2/2019 | Tsai | H01R 13/6585 |
| 10,320,125 | B2 * | 6/2019 | Ju | H01R 13/6585 |
| 10,411,389 | B2 * | 9/2019 | Zhao | H01R 13/405 |
| 2017/0201048 | A1 | 7/2017 | Kong et al. | |
| 2019/0067879 | A1 * | 2/2019 | Zhao | H01R 13/6585 |
| 2019/0131745 | A1 * | 5/2019 | Zhao | H01R 13/6585 |

* cited by examiner

ELECTRICAL CONNECTOR HAVING A CERAMIC BODY PART AND A METALLIC SHIELDING PLATE MOLDED TO THE CERAMIC BODY PART

CROSS-REFERENCE TO RELATED APPLICATIONS

This patent application relates to a U.S. patent application Ser. No. 16/111,244 filed on Aug. 24, 2018, entitled "ELECTRICAL CONNECTOR HAVING AN IMPROVED TONGUE PORTION," which is assigned to the same assignee as this application.

BACKGROUND OF THE INVENTION

1. Field of the Invention

The present invention relates to an electrical connector having a ceramic body, two rows of contacts secured to the ceramic housing, and a metallic shielding plate situated between respective differential signal pairs of the two rows of contacts.

2. Description of Related Arts

China Patent No. 205944552 discloses an electrical connector utilizing ceramic materials in constructing its insulative body or housing. Due to high sintering temperature of ceramic materials, risk of melting an otherwise plastic housing under high temperature is avoided. However, such electrical connector does not shield high frequency signal interference during high frequency signals transmission.

SUMMARY OF THE INVENTION

An electrical connector comprises: a body including a ceramic part and an over-mold; an upper row of contacts and a lower row of contacts secured to the ceramic part of the body, each row of contacts including an outermost ground contact and a pair of signal contacts inwardly of the ground contact; and a metallic shielding plate situated between the upper pair of signal contacts and the lower pair of signal contacts, wherein the metallic shielding plate is molded to the ceramic part of the body.

DETAILED DESCRIPTION OF THE PREFERRED EMBODIMENT

Figure 1:
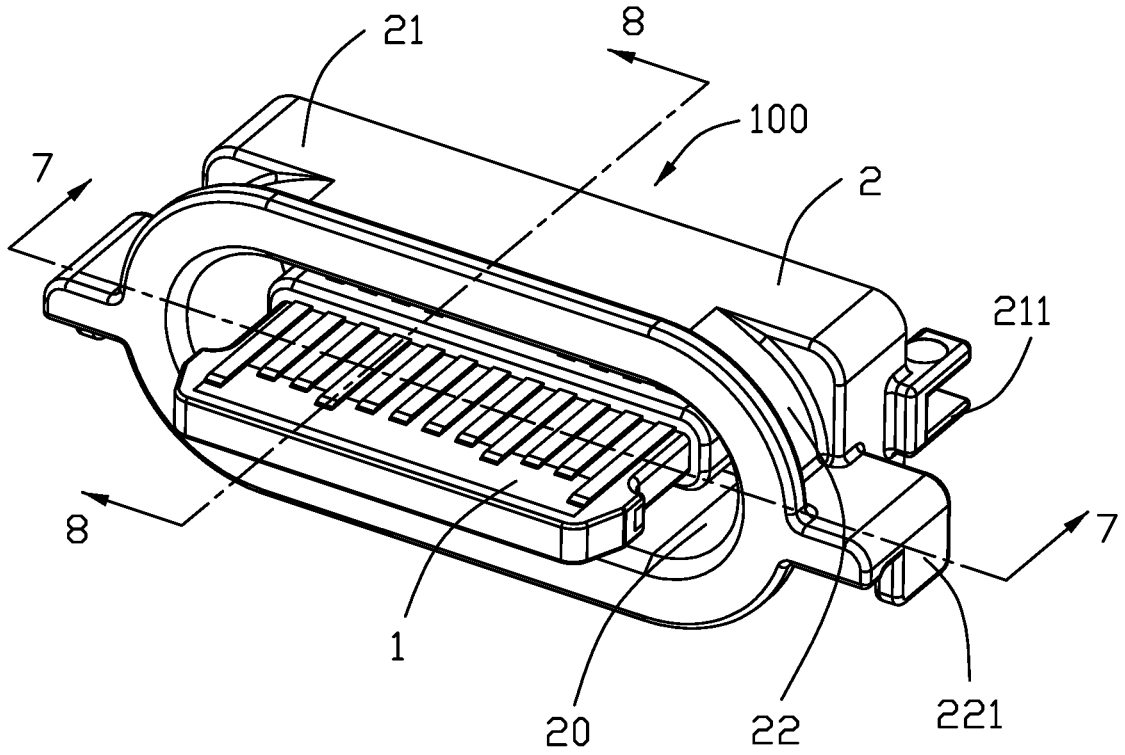
FIG. 1 is a perspective view of an electrical connector in accordance with a first embodiment of the present invention.

Referring to FIGS. 1 to 7, an electrical connector 100 of a first embodiment discloses a contact module 1 enclosed by a shielding shell 2 and sealed by a rear sealing member 3.

Referring to FIGS. 3-7, the contact module 1 includes a body 11, two rows of contacts 12 secured to the body 11, and a pair of metallic shielding plates 1232 situated between an upper row of contacts 121 and a lower row of contacts 122.

The body 11 includes a base 111 and a tongue 112. The tongue 112 has a pair of side notches 1121. The body 11 is constructed of a ceramic part 113 for securing the contacts 12 and an over-mold 114 molded over the combination of the ceramic part 113 and the secured contacts 12. The ceramic part 113 has a vertical slot 1132 and a horizontal slot 1131. Notably, in this embodiment, the base 111 is essentially formed by the over-mold 114. Two opposite faces of the ceramic part 113 form a plurality of contact grooves 1133 to receive the corresponding contacts 12 therein, respectively.

Each contact 12 includes a contacting portion 126, a soldering portion 128, and a securing portion 127 between the contacting portion and the soldering portion. Each row of contacts 121 or 122 includes a pair of outermost ground contacts 123, a respective pair of high-speed signal contacts 125 next to each of the two ground contacts, a respective power contact 124 inwardly of and next to each pair of signal contacts, and other signal contacts. In this embodiment, the ground contact 123 is integral with the metallic shielding plate 1232 as a uni-body which is formed by suitable metal injection molding process, such as sintering in metallurgy powder-related processes known as powder metallurgy, in the slots 1131 and 1132 of the ceramic part 113 of the body 11. The other contact are stitched, i.e., inserted into the ceramic part 113 of the body 11. The metallic shielding plate 1232 may be integral with only one or both of the associated upper and lower ground contacts. The horizontal slot 1131 extends between associated upper pair of high-speed signal contacts 125 and associated lower pair of high-speed signal contacts 125. The metallic shielding plate 1232 has a side protrusion 1231 exposed to a corresponding side notch 1121.

Figure 2:
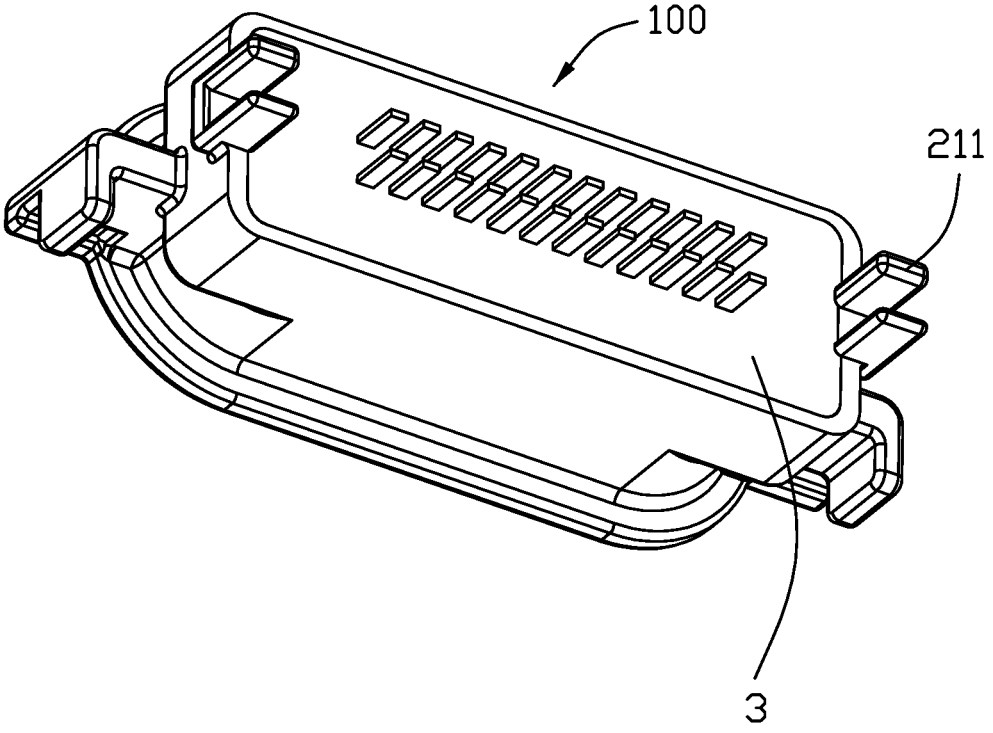
FIG. 2 is another perspective view of the electrical connector.
Figure 3:
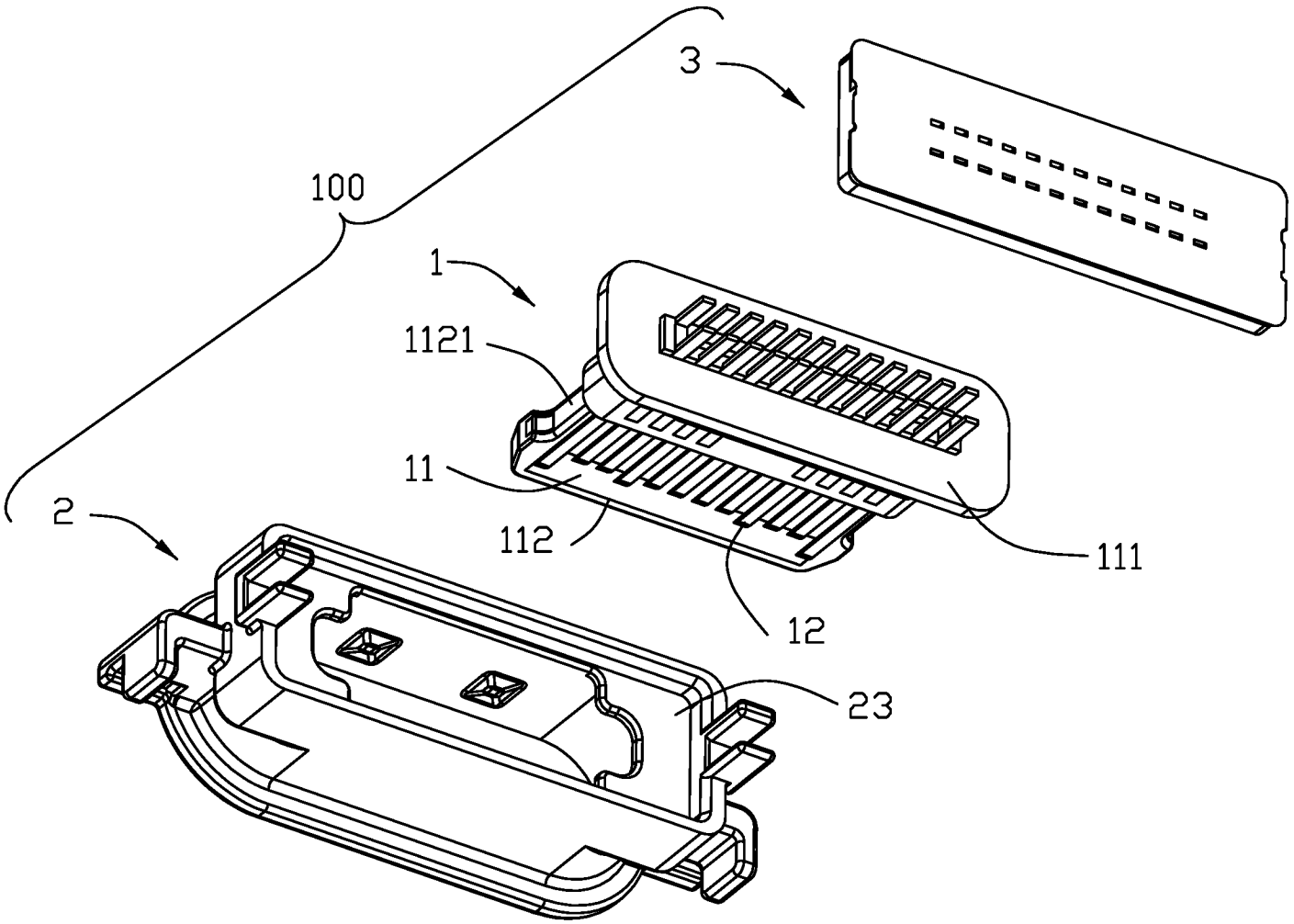
FIG. 3 is an exploded view of the electrical connector.
Figure 4:
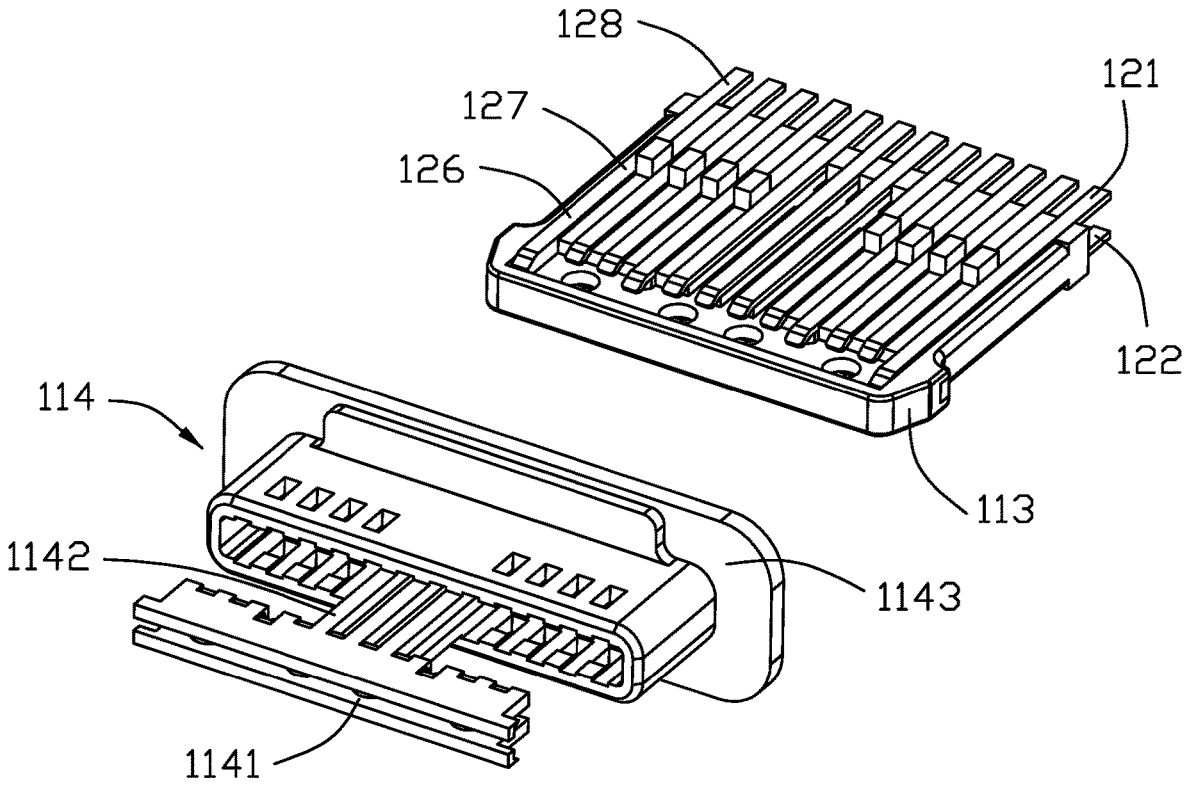
FIG. 4 is an exploded view of a contact module of the electrical connector.
Figure 5:
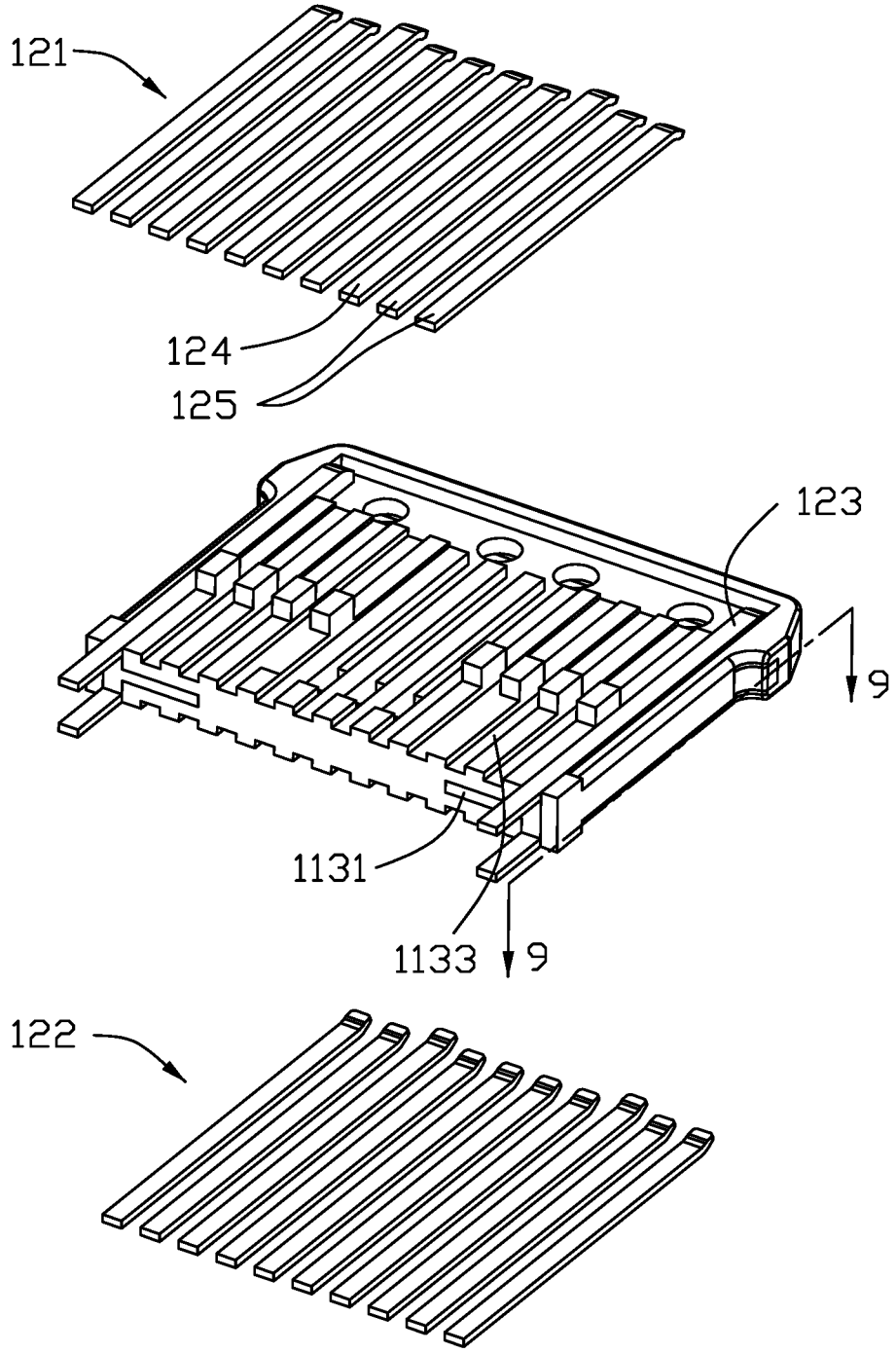
FIG. 5 is a further exploded view of the contact module omitting an over-mold thereof.
Figure 6:
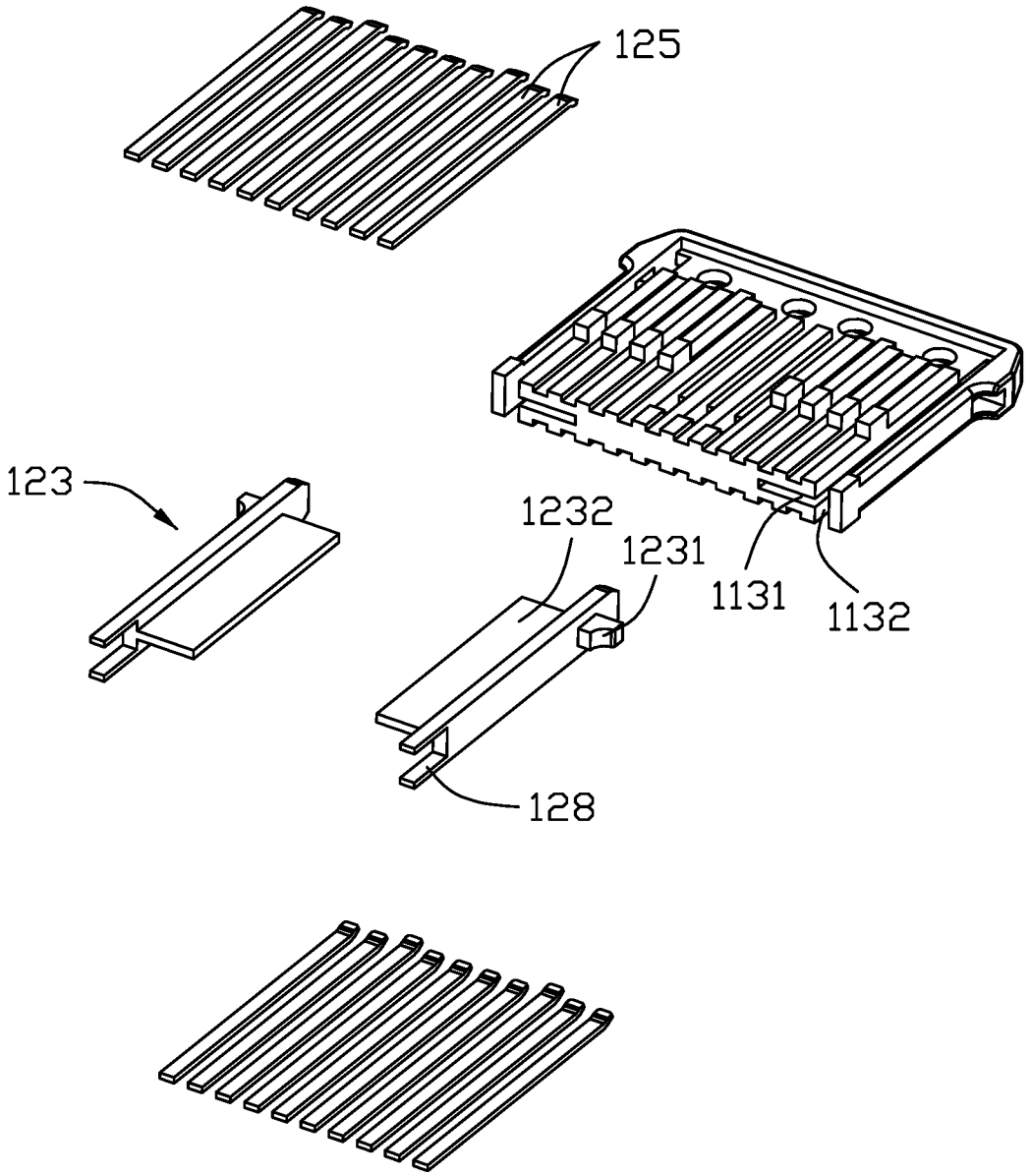
FIG. 6 is a further exploded view of FIG. 5.
Figure 7:
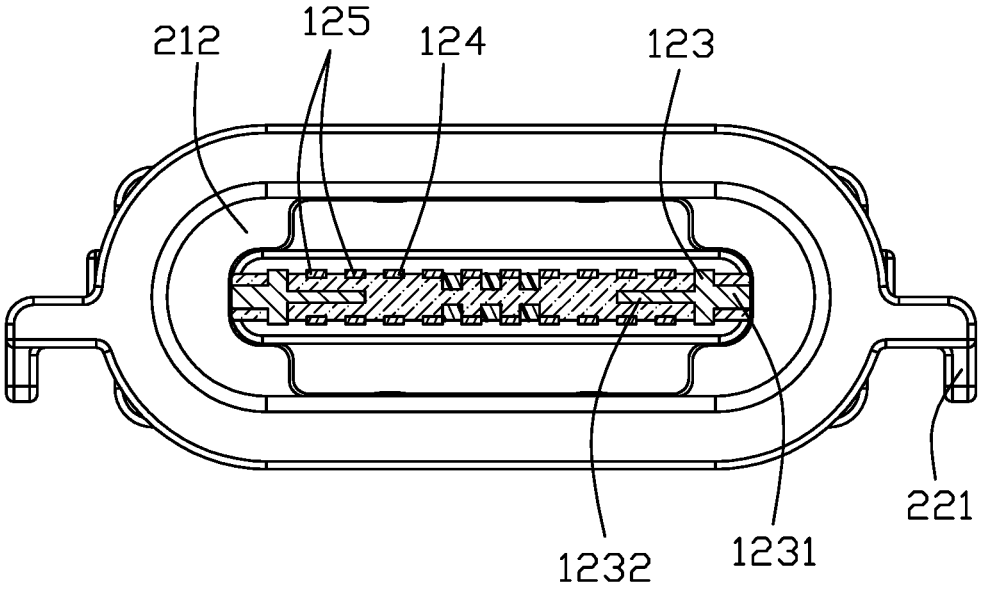
FIG. 7 is a cross-sectional view of the electrical connector taken along line 7-7 in FIG. 1.

Referring to FIGS. 1-2 and 7, the shielding shell 2, which is made via die-casting, sintering or metal injection molding, has a receiving space 20 for the contact module 1. The shielding shell 2 includes a rear part 21 and a front part 22. The rear part 21 has plural soldering legs 211 for clamping to a printed circuit board. On an inner side of the rear part 21 there are two stops 212. On an outer side of the front part 22 there are two positioning portions 221.

Referring to FIGS. 8-12, an electrical connector 200 of a second embodiment discloses a contact module 4 enclosed by a shielding shell 5 and sealed by a rear sealing member 6.

Referring to FIGS. 9-12, the contact module 4 includes a body 41, two rows of contacts 42 secured to the body 41, and a pair of metallic shielding plates 7 situated between an upper row of contacts 421 and a lower row of contacts 422.

The body 41 includes a base 411 and a tongue 412. The tongue 412 has a pair of side notches 4121. The body 41 is constructed of a ceramic part 413 for securing the contacts 42 and an over-mold 414 molded over the combination of the ceramic part 413 and the secured contacts 42. The ceramic part 413 has a horizontal slot 4131.

Each contact 42 includes a contacting portion 426, a soldering portion 428, and a securing portion 427 between the contacting portion and the soldering portion. Each row of contacts 421 or 422 includes a pair of outermost ground contacts 423, a respective pair of high-speed signal contacts 425 next to each of the two ground contacts, a respective power contact 424 inwardly of and next to each pair of signal contacts, and other signal contacts. In this embodiment, all contact are stitched, i.e., inserted into the ceramic part 413 of the body 41.

The metallic shielding plate 7 is formed by suitable metal injection molding process, such as sintering in metallurgy powder-related processes known as powder metallurgy, in the slot 4131 of the ceramic part 413 of the body 41. The slot 4131 extends between associated upper pair of high-speed signal contacts 425 and associated lower pair of high-speed signal contacts 425. The metallic shielding plate 7 has a side protrusion 71 exposed to a corresponding side notch 4121.

Figure 8:
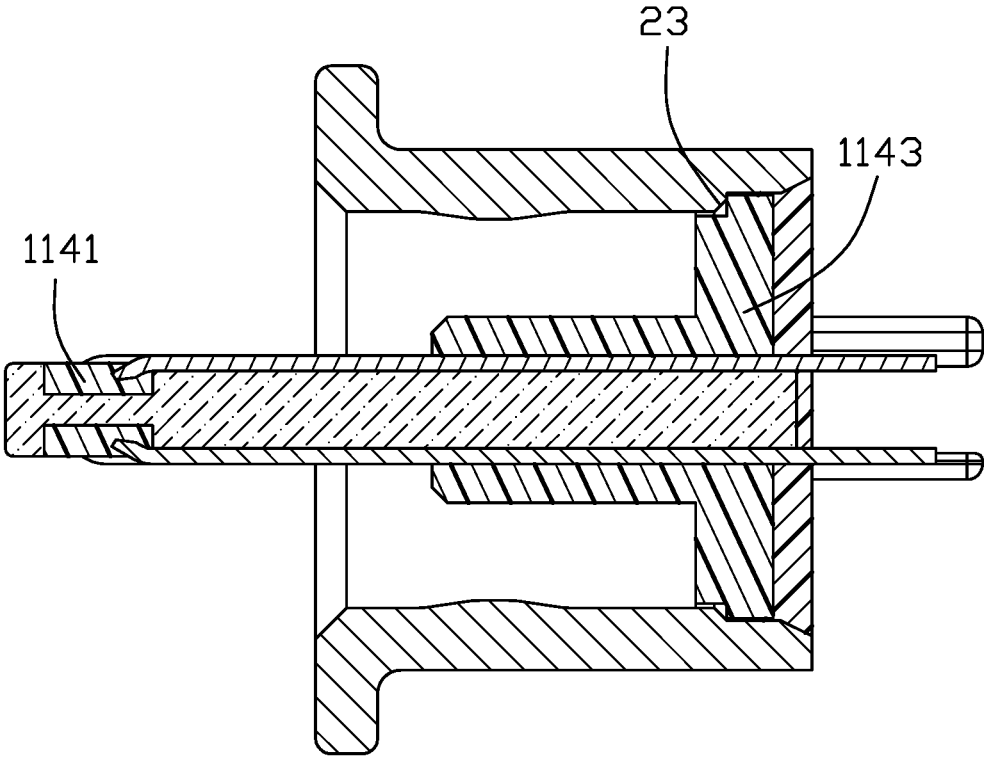
FIG. 8 is another cross-sectional view of the electrical connector taken along line 8-8 in FIG. 1.
Figure 9:
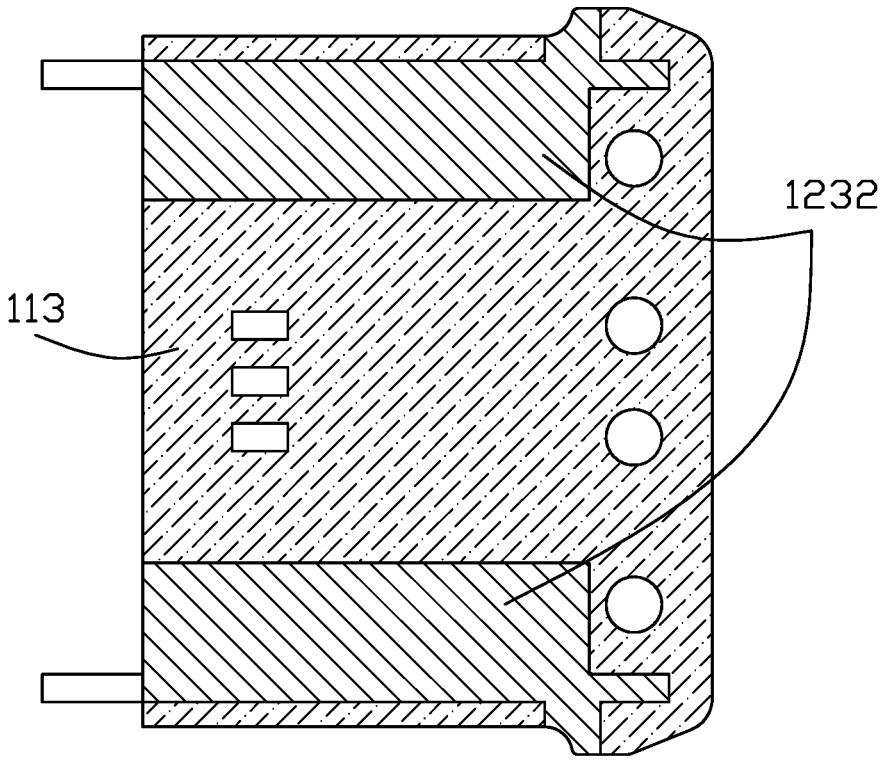
FIG. 9 is a cross-sectional view of the ceramic part of the electrical connector taken along line 9-9 in FIG. 5.
Figure 10:
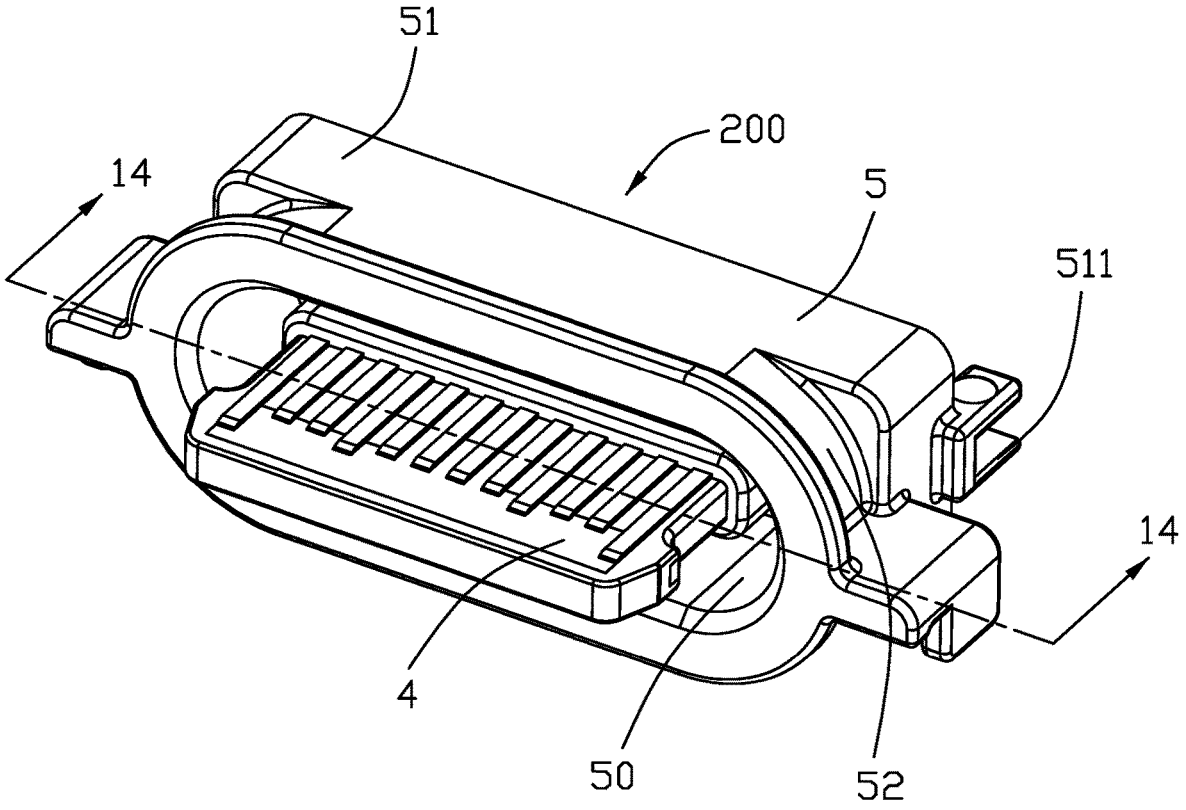
FIG. 10 is a perspective view of an electrical connector in accordance with a second embodiment of the present invention.
Figure 11:
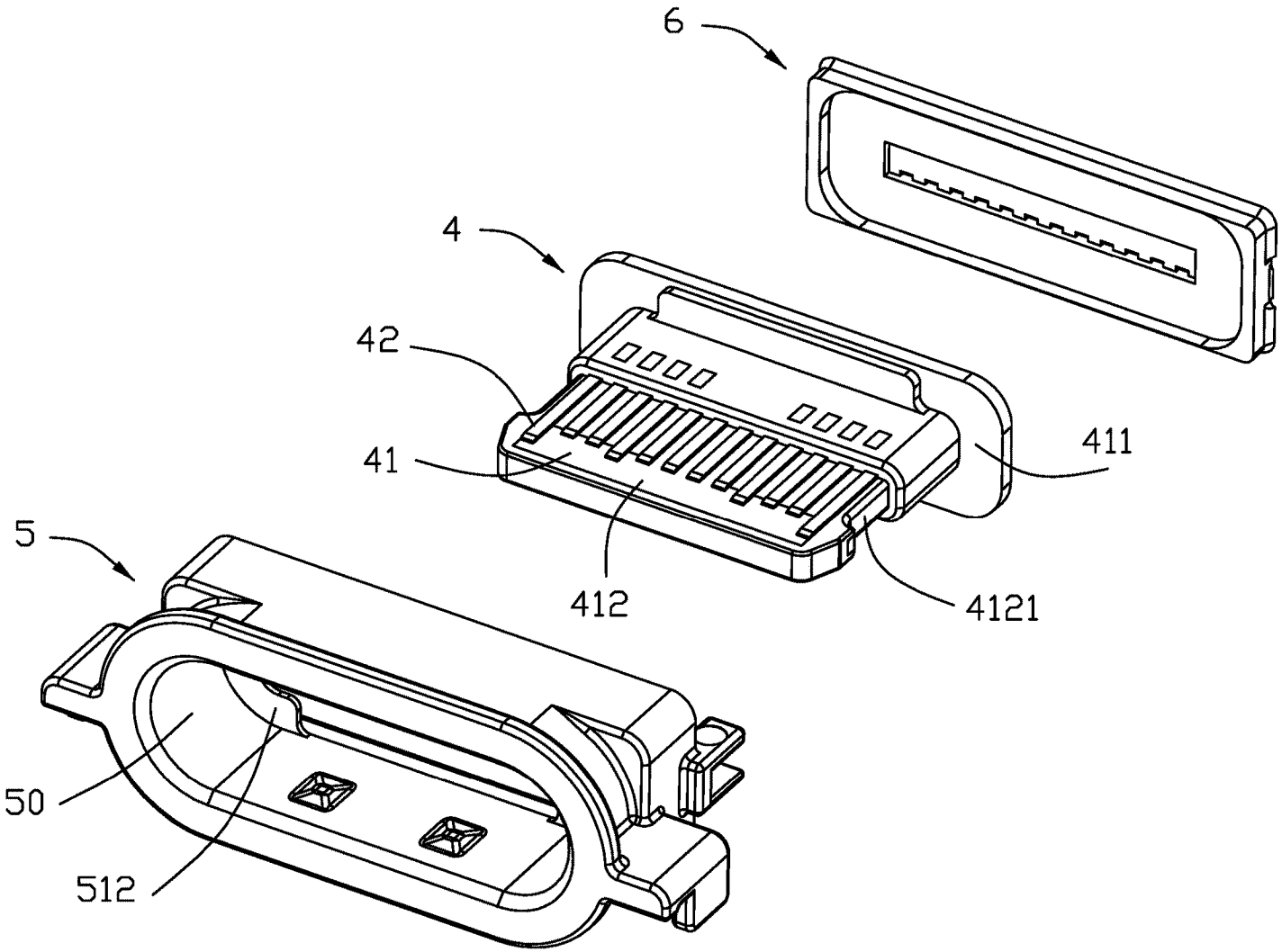
FIG. 11 is an exploded view of the electrical connector in FIG. 10.
Figure 12:
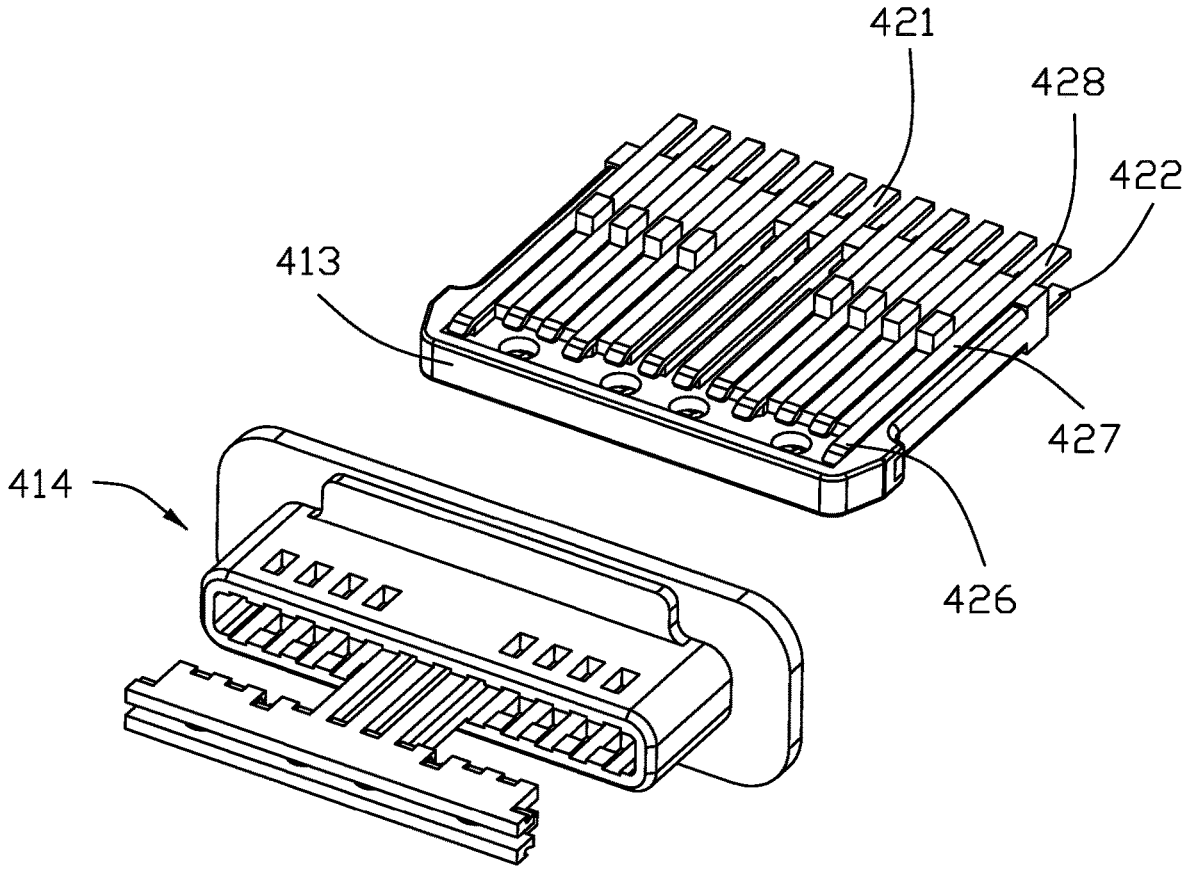
FIG. 12 is an exploded view of a contact module of the electrical connector in FIG. 10.
Figure 13:
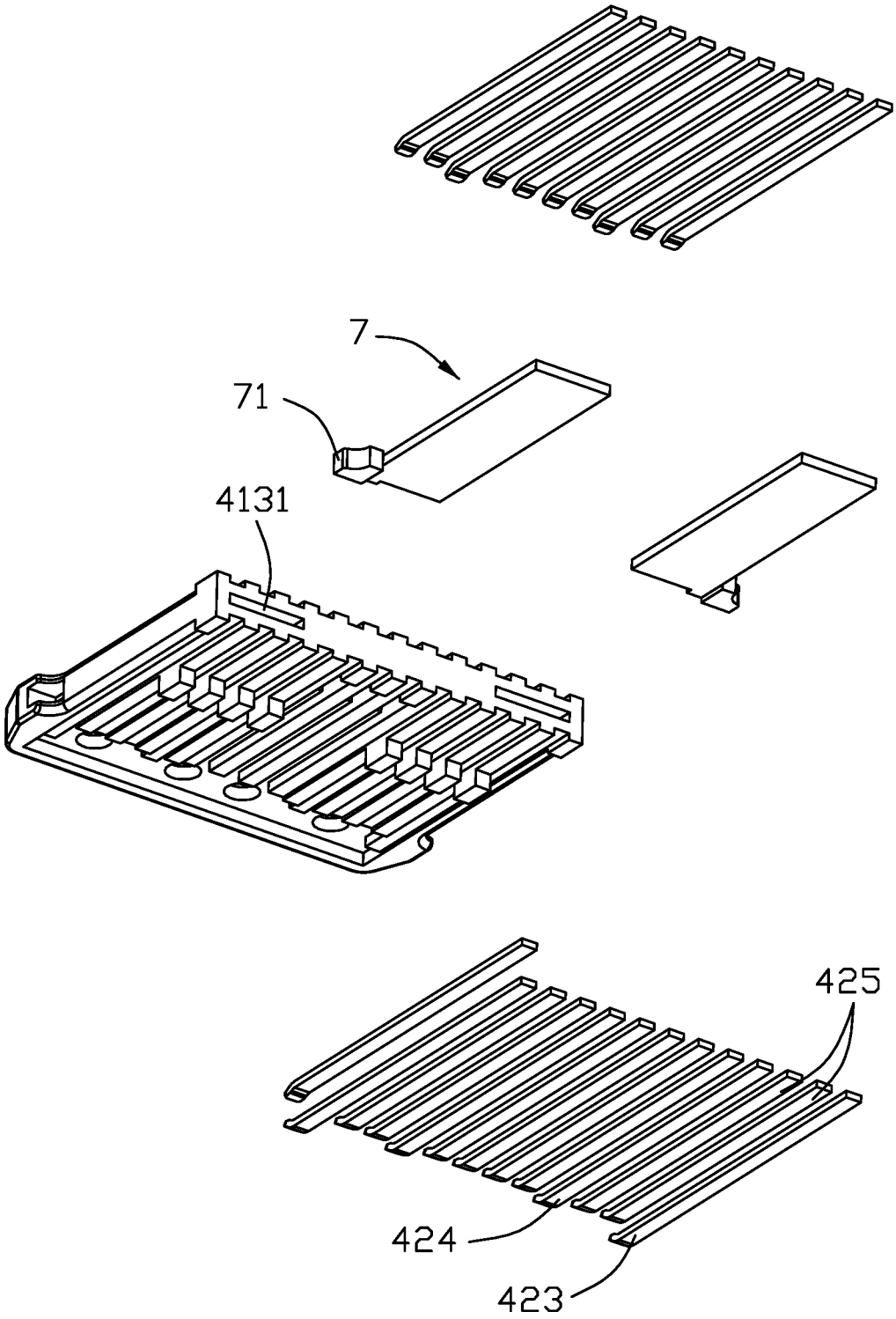
FIG. 13 is a further exploded view of the contact module in FIG. 12 omitting an over-mold thereof.
Figure 14:
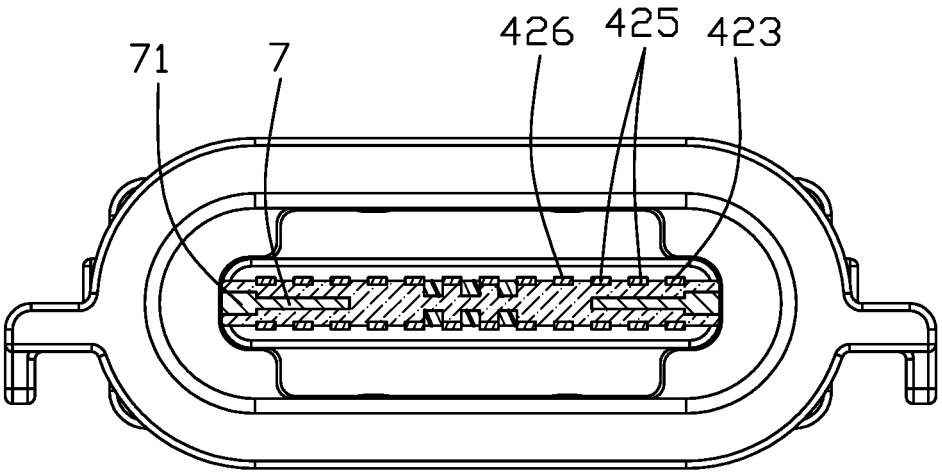
FIG. 14 is a cross-sectional view of the electrical connector in FIG. 10 taken along line 14-14 thereof.

Referring to FIGS. 8-9 and 12, the shielding shell 5 has a receiving space 50 for the contact module 4. The shielding shell 5 includes a rear part 51 and a front part 52. The rear part 51 has plural soldering legs 511 for clamping to a printed circuit board. On an inner side of the rear part 51 there are two stops 512. On an outer side of the front part 52 there are two positioning portions 521.

Compared to prior art, use of molded, e.g., sintered, metallic shielding plate in ceramic body part between upper row high-speed signal pair and lower row high-speed signal pair achieves high-frequency and large-current applications without fear of signal interference and melting of materials. Notably, because the shielding plate is molded within the ceramic body as a one-piece structure, it is impossible to disassemble the shielding plate and the ceramic part from each without damages. In other words, the structures of the shielding plate are interengaged with those of the ceramic part to disassemble them from each other. Differently, all prior arts only disclose the preformed metallic shielding plate as an original base for further assembled or molded with the plastic part for forming the terminal module. Notably, in these embodiment, the terminal module is preformed and then assembled into the shielding shell. Anyhow, in other arrangements with different configurations of the terminal module and the shielding shell, the over-mold may be applied upon the ceramic part which is already disposed in the shielding shell so as to have the over-mold also integrally formed with the interior structure of the shielding shell, thus resulting in inherent securement between the over-mold and the shielding shell directly. In this embodiment, the over-mold 114 includes a front crossbar 1141 extending in a transverse direction to press front ends of the contacts for reliably securing the contacts in position upon the ceramic part. The over-mold 114 further includes a middle part 1142 to connect the front crossbar 1141 to the rear main part 1143 which forwardly abuts against the divider 23 of the shielding shell 2. Notably, the middle part 1142 is aligned with a space between two metallic shielding plate units 1232, i.e., being offset from the shielding plate units 1232 in the transverse direction.

What is claimed is:

1. An electrical connector comprising:

a contact module including a body, two rows of contacts respectively disposed on two opposite faces of the body, and a metallic shielding plate disposed between two rows of the contacts in a vertical direction, said body including a ceramic part and an over-mold applied upon the ceramic part after the ceramic part is preformed and the contacts have been positioned upon the ceramic part, wherein the ceramic part forms a horizontal slot extending through a face thereof and between said two rows of contacts in said vertical direction to separate said two rows of contacts from each other, and the shielding plate is formed within the horizontal slot by metal injection molding through said face after the ceramic part is preformed while before the over-mold is formed.

2. The electrical connector as claimed in claim 1, wherein structures of the shielding plate and those of the ceramic part are interengaged with each other as one piece so that no possibility to disassemble the shielding plate and the ceramic part from each other without damaging either the shielding plate or the ceramic part.

3. The electrical connector as claimed in claim 2, wherein the shielding plate includes a side protrusion exposed upon a side notch of the body.

4. The electrical connector as claimed in claim 3, wherein the shielding plate further unitarily forms a plurality of grounding contacts exposed upon said two opposite faces of the body.

5. The electrical connector as claimed in claim 1, wherein the over-mold includes a crossbar at a front region to press front ends of the contacts toward the ceramic part in said vertical direction.

6. The electrical connector as claimed in claim 5, wherein the over-mold further includes a middle part offset from the shielding plate in a transverse direction perpendicular to the vertical direction.

7. The electrical connector as claimed in claim 6, wherein the over-mold further includes a main part behind the middle part abutting against a divider of a metallic shielding shell which encloses the terminal module and separates space in the shielding shell into two portions in a front-to-back direction perpendicular to both the vertical direction and the transverse direction.

8. The electrical connector as claimed in claim 1, wherein said horizontal slot extends in a front-to-back direction perpendicular to the vertical direction.

9. The electrical connector as claimed in claim 1, wherein said face is a rear face.

10. A method of making an electrical connector comprising sequential steps of:

forming a ceramic part by metal injection molding, said ceramic part forming a plurality of contact grooves in two opposite faces in a vertical direction, and a horizontal slot between the two opposite faces in the vertical direction;

forming a metallic shielding plate in the horizontal slot via metal injection molding;

placing a plurality of contacts into the corresponding contact grooves; and forming an over-mold via molding upon the ceramic part and the contacts to form a terminal module.

11. The method as claimed in claim 10, wherein the shielding plate unitarily forms a side protrusion and exposed to an exterior in a transverse direction perpendicular to the vertical direction.

12. The method as claimed in claim 11, wherein the shielding plate further unitarily forms a grounding contact exposed upon the corresponding one of said two opposite faces.

13. The method as claimed in claim 11, further including a step of forming a metallic shielding shell made by metal injection molding to receive the terminal module therein, wherein said shielding shell includes a divider and the terminal module includes a base forwardly abutting against the divider.

14. The method as claimed in claim 13, wherein said base is formed by the over-mold only.

15. The method as claimed in claim 11, wherein said over-mold includes a crossbar in a front region to press front ends of the contacts in the vertical direction.

16. The method as claimed in claim 15, wherein said over-mold further includes a middle part behind the crossbar and offset from the shielding plate in the transverse direction.

* * * * *